US008091744B2

(12) United States Patent
Zwahlen

(10) Patent No.: US 8,091,744 B2
(45) Date of Patent: Jan. 10, 2012

(54) ARRANGEMENT FOR POURING FREE-FLOWING MEDIA FROM A CONTAINER

(75) Inventor: Jürg Zwahlen, Triesen (LI)

(73) Assignee: Birchmeier Sprühtechnik AG, Stetten (CH)

( * ) Notice: Subject to any disclaimer, the term of this patent is extended or adjusted under 35 U.S.C. 154(b) by 647 days.

(21) Appl. No.: 12/280,736

(22) PCT Filed: Feb. 27, 2007

(86) PCT No.: PCT/CH2007/000098

§ 371 (c)(1),
(2), (4) Date: Aug. 26, 2008

(87) PCT Pub. No.: WO2007/098626

PCT Pub. Date: Sep. 7, 2007

(65) Prior Publication Data

US 2009/0032556 A1 Feb. 5, 2009

(30) Foreign Application Priority Data

Mar. 3, 2006 (CH) ..... 0344/06

(51) Int. Cl.
*B67D 3/00* (2006.01)

(52) U.S. Cl. ..... 222/534; 222/153.01

(58) Field of Classification Search ..... 222/534, 222/530, 481.5, 465.1, 510, 482, 526–529, 222/425, 5, 387–389, 536–539, 153.01, 153.1, 222/153.14; 239/387–289

See application file for complete search history.

(56) References Cited

U.S. PATENT DOCUMENTS

| | | | | | |
|---|---|---|---|---|---|
| 77,755 | A | * | 5/1868 | Ogden | 222/484 |
| 1,290,814 | A | * | 1/1919 | Weaver | 73/306 |
| 2,040,584 | A | * | 5/1936 | Wlswell | 141/330 |
| 2,134,852 | A | * | 11/1938 | Bogan | 222/153.02 |
| 5,628,352 | A | | 5/1997 | Gracyalny et al. | |
| 6,045,013 | A | * | 4/2000 | Yang | 222/510 |
| 7,513,394 | B2 | * | 4/2009 | Bone | 222/481.5 |

FOREIGN PATENT DOCUMENTS

| | | | | |
|---|---|---|---|---|
| DE | 4214171 | * | 11/1993 | 222/534 |
| FR | 2669184 | * | 11/1990 | 222/534 |
| GB | 2389302 | * | 12/2003 | 222/534 |
| WO | WO 2004/020298 | | 3/2004 | |

* cited by examiner

*Primary Examiner* — Lien Ngo
(74) *Attorney, Agent, or Firm* — Henry M. Feiereisen; Ursula B. Day

(57) ABSTRACT

The invention relates to an arrangement for pouring free-flowing media out of a container. The arrangement contains a pour-out valve (3, 50) which can be specifically opened and closed by the user via an easy to operate actuating device (9), and thus allows a controlled pouring-out action. A pour-out tube (2) arranged in a pivotable manner on the container (1) makes it possible, depending on the position of the pivoted pour-out tube (2), to lock or unlock the pour-out valve (3, 50) using a blocking device. Locking the pour-out valve in the closed position prevents accidental opening of the pour-out valve (3, 50). The arrangement according to the invention also contains a venting valve (8), which can likewise be locked in the closed state. A compression spring ensures that, in the rest state, that is to say when the actuating device (9) is not actuated, the pour-out valve (3, 50) seals off the spout and the venting valve (8) is likewise closed.

10 Claims, 9 Drawing Sheets

ARRANGEMENT FOR POURING FREE-FLOWING MEDIA FROM A CONTAINER

BACKGROUND OF THE INVENTION

The invention relates to an arrangement for pouring free-flowing media.

Conventional pouring-out arrangements on containers for storing and dispensing partial quantities of free-flowing media comprise a container body with a closable spout and a likewise closable filling opening. In the closed state, the container is closed in a sealing manner so that the medium located in the container cannot flow out regardless of the position of the container. This type of container is used, for example, as a refilling container for small tanks or as containers of concentrates or additives in which only a partial quantity is removed from the container during each use. For pouring out, a pour-out tube can be screwed or fitted onto the container and when required, the refill opening is screwed on so that air can flow into the container to allow continuous pouring-out. At the end of the pouring-out process, the pour-out tube is removed from the pour-out opening again and stored and the container is closed. The handling of containers having such a pouring-out arrangement is laborious and has the risk that the liquid can run out freely when the unclosed container is tilted. Frequently a movable bellows is used as a pour-out tube for better adaptation to the respective position of the tank or container to be filled. In this case, residual quantities of the filled medium remain in the grooves of the bellows. This has the disadvantage that the pour-out tube or the bellows and the container in the area of the spout is contaminated with the filling medium on every use, which inevitably has the result that the user comes in contact with the filling medium. In addition, the pour-out tube can easily be lost if it is detached from the container.

Known from the publication WO2004/020298 is a container in the form of a petrol can having a pour-out arrangement comprising a spout with a pour-out valve, an actuating device for a pour-out valve, a pour-out tube arranged on the container, a venting valve and a closable filling opening. The flexible pour-out tube screwed onto the spout is covered with a closure cap at its outer end as is the venting valve when not in use, thus ensuring that the container is tightly sealed when not in use. The pour-out valve is controlled by means of a connecting member with a push button which at the same time actuates the venting valve so that when the pour-out valve is opened, the venting valve is also opened. When not in use, both the pour-out valve and the venting valve are closed. In order to be able to remove petrol from the can, the closure caps are first unscrewed from the flexible pour-out tube and from the venting valve. Then by actuating the push button, petrol can be removed from the container in a metered manner. The disadvantage of this arrangement is that closure caps have to be screwed on for securing and for tightly sealing the container. In addition, during transportation of the container, for example, small quantities of petrol can seep through the pour-out valve into the pour-out tube or through the venting valve into the cover caps which can lead to contamination when unscrewing the cover caps from the pour-out tube or from the venting valve.

SUMMARY OF THE INVENTION

The object of the present invention is to eliminate these disadvantages of the known arrangements for pouring out free-flowing media from a container.

The basic idea of the invention is that with the arrangement according to the invention for pouring out free-flowing media without mounting loose and additional parts, a container can be transferred from the closed and securely sealed state to an operationally ready state and back again. For this purpose, the invention comprises a pour-out valve that can be specifically opened and closed by the user by means of an easy-to-operate actuating mechanism and thus allows controlled pouring-out. A pour-out tube arranged pivotally on the container makes it possible to lock or unlock the pour-out valve according to the position of the pivoted pour-out tube by means of a blocking device. Locking the pour-out valve in the closed position avoids any unintentional opening of the pour-out valve. The arrangement according to the invention further comprises a venting valve which can likewise be locked in the closed state. A compression spring ensures that in the rest state, that is when the pour-out control is not actuated, the pour-out valve sealingly closes the spout and the venting valve is likewise closed.

The arrangement according to the invention is used for pouring out various free-flowing media from a container. In this case, the arrangement can be integrated in the container itself or in a lid of the container. The free-flowing medium can, for example, be cleaning agents, lubricants, petrol, screen wash agents, antifreeze agents, additives in the construction area and many others. Free-flowing media are to be understood as fine-grained powders, granules and the like which are stored airtight in containers and are removed from the container in small partial quantities. The container fitted with the pour-out arrangement forms a storage and transport container from which a partial amount of its content can be removed from time to time. For the removal of a partial quantity of the content from the container, the pour-out tube is initially pivoted away from the container into the pour-out position. At the same time, the pour-out valve is unlocked. The venting valve is then unlocked and by actuating the pour-out control, both the pour-out valve and the venting valve are opened and the content can be poured out. In this case, the pouring out is effected in a controlled manner without any of the contents spilling and without the user coming in contact with the content of the container. A tube with a smooth inner wall is used as the pour-out tube, so that no residual quantities remain in the pour-out tube after the pour-out process. At the end of removal, the pour-out control is released, whereby the compression spring closes both the pour-out valve and the venting valve, the pour-out tube is pivoted into the blocked position and the venting valve is locked. The container is therefore sealed again and reliably closed. The locking of the pour-out valve and the venting valve make it impossible for the free-flowing medium to flow unintentionally out of the container.

Further advantages of the invention follow from the dependent claims and from the following description in which the invention will be explained in detail with reference to two exemplary embodiments shown in the drawings.

DETAILED DESCRIPTION OF PREFERRED EMBODIMENTS

Figure 1:
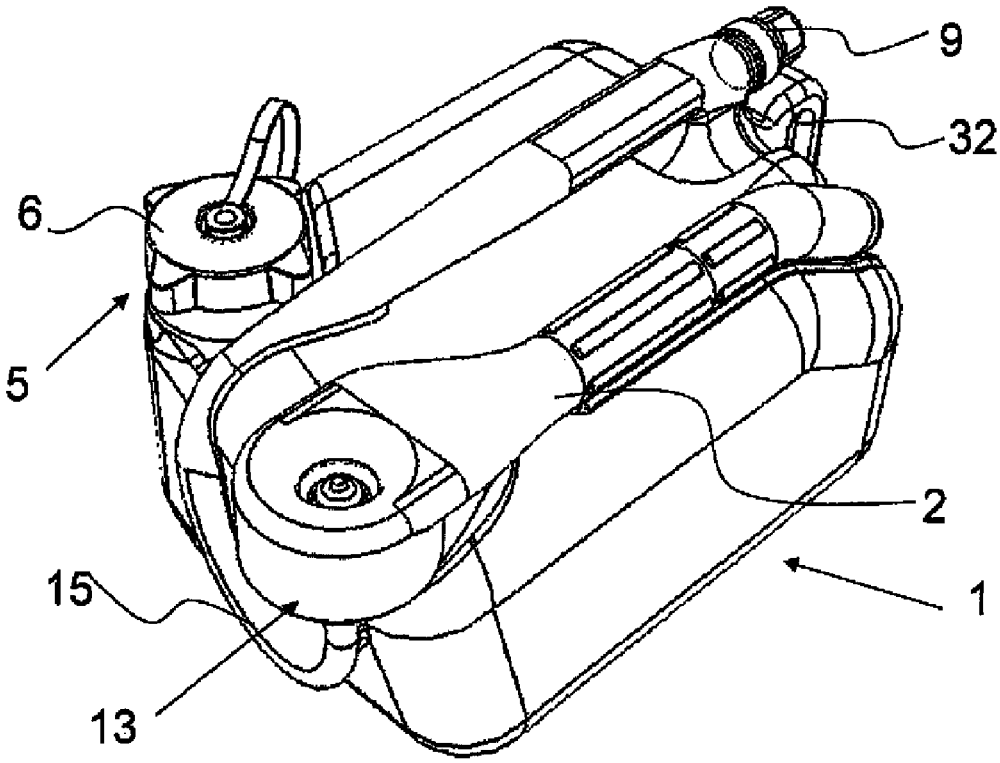
FIG. 1 shows a container with integrated pour-out arrangement in perspective view.

In the figures the same reference numerals have always been used for the same elements and explanations for the first time relate to all figures unless expressly stated otherwise.

FIG. 1 shows a portable container 1 with an exemplary embodiment of the pour-out arrangement according to the invention. The essential components of this arrangement are a pour-out tube 2 arranged pivotally on the spout 13 of the container 1 comprising a pour-out valve arranged in the interior of the pour-out tube 2 and a lock for the pour-out valve, an actuating device 9 with a push-button for actuating the pour-out valve, a connecting member between the push button and the pour-out valve and a lockable venting valve integrated in the actuating device 9. Also provided on the upper side of the container is a filling opening 5 which can be closed with a lid 6 and a handle 32. The filling opening 5 is arranged on the container 1 in such a manner that it lies lower than the upper container boundary. This has the result that the container 1 cannot be overfilled. When, during filling of a container placed on the ground, the level of the filling opening is reached, a sufficiently large gas cushion remains inside the container 1, capable of absorbing volume and pressure fluctuations accompanying temperature fluctuations. The actuating device 9 is arranged close to the container handle 32 so that the container can be held by the handle 32 in one hand and the push button 10 on the actuating device 9 can be operated with the same hand. The pour-out tube 2 is pivoted over the container 1 and is located in the blocking position. In this position, the pour-out valve is locked and the container 1 tightly closed.

Figure 2:
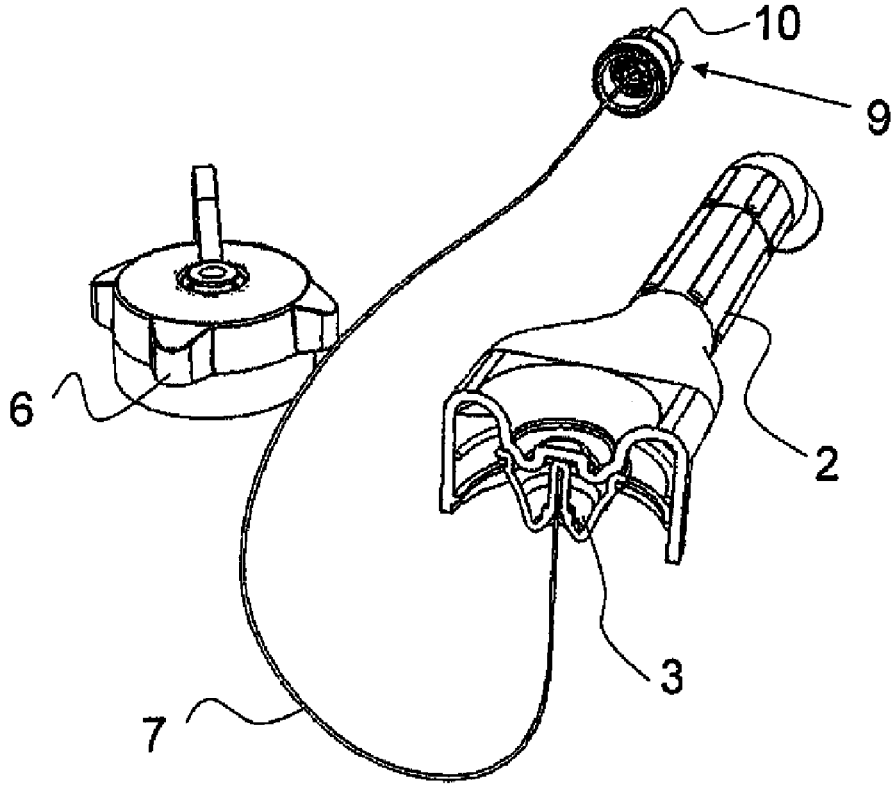
FIG. 2 shows the individual components of the pour-out arrangement.

FIG. 2 shows the components of the pour-out arrangement in detail, wherein the pour-out tube 2 is cut away in the area of the pour-out valve 3 located inside the pour-out tube 2. A flexible push rod 7 can be identified as the connecting member between the actuating device 9 and the pour-out valve 3, said push rod being guided in a channel 15 integrated in the container wall. The push rod 7 can also be guided in a channel- and/or tube-like structure which is formed as part of the container or they can be separately inserted parts. The push rod 7 can, for example, be a flexible, bendable length of metal or plastic whose length is matched to the curve path of the channel in which it is guided and extends from the actuating device 9 as far as the pour-out valve 3. The connecting member 7 can be composed of a plurality of individual elements.

Figure 3:
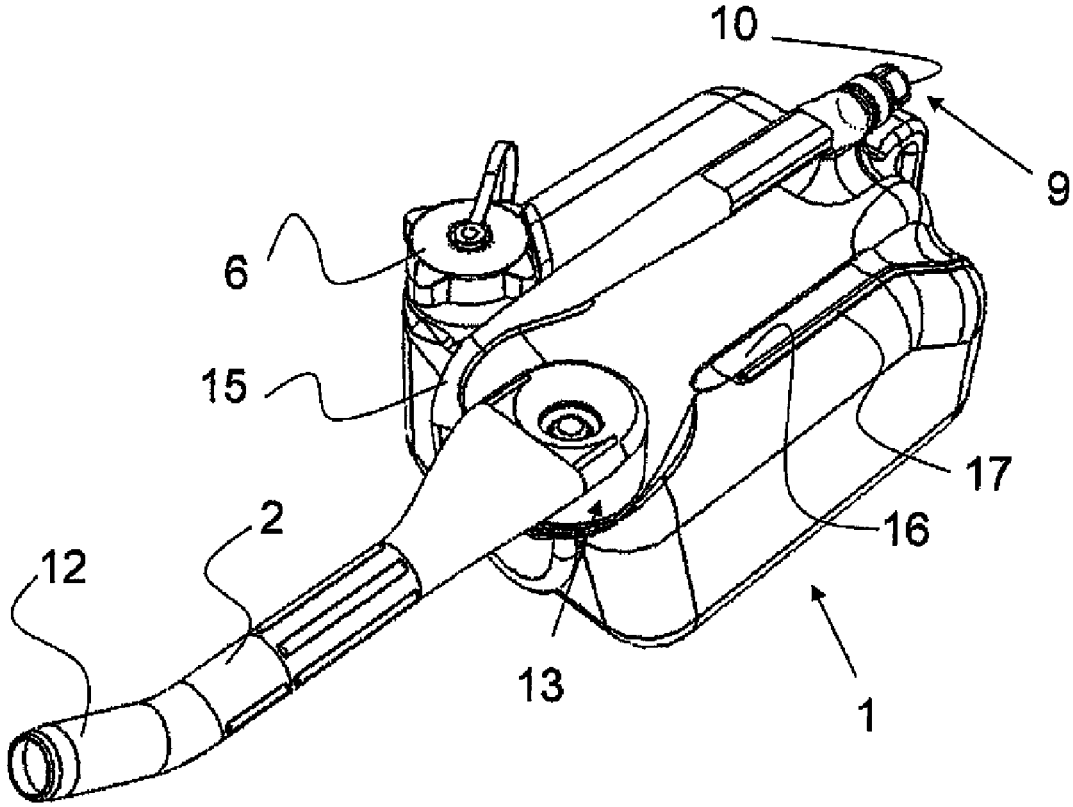
FIG. 3 shows a container with integrated pour-out arrangement with pivoted pour-out tube in perspective view.

FIG. 3 shows the container 1 with pivoted pour-out tube 2 ready for pouring out, i.e. in this position the pour-out valve 3 is unlocked but still closed. By pressing the push button 10 the push rod 7 is pushed along the channel 15 towards the pour-out valve 3 which is thereby opened. In the embodiment shown, the pour-out tube 2 is arranged pivotally about an axis running parallel to the pour-out collar 14 of the spout 13, being pivotable through about 180° from the blocking position into the pour-out position. For a container standing on the ground, this corresponds to an approximately horizontal pivoting process. However, it is also feasible to have a pivoting arrangement at the spout 13 which allows pivoting of the pour-out tube 2 running in the vertical direction, wherein the pour-out valve 3 is likewise locked in the blocking position and in the pour-out position of the pour-out tube 2, the pour-out valve 3 is unlocked. A pour-out connecting piece 12 is rotatably arranged at the front end of the pour-out tube 2. The pour-out connecting piece 12 has a slight bend or arcuate profile. As a result, the pour-out tube 2 with the pour-out connecting piece 12 can be introduced more simply and more easily into the opening of a vessel or container to be filled. A recess 16 can also be identified on the upper side of the container 1 which serves to accommodate the pour-out tube 2 in the blocking position. The outer flank of the recess 16 is slightly elevated and forms a rib 17 running parallel to the recess 16. On pivoting the pour-out tube 2 into the blocking position, the pour-out tube 2 must be pressed with gentle pressure over this rib 17 so that it ultimately comes to rest in a gently engaging manner in the recess 16. As a result, the pour-out tube 2 cannot be pivoted unintentionally from the blocking position. The pour-out tube must be pressed away over the rib 17 with slight pressure for pivoting.

Figure 4:
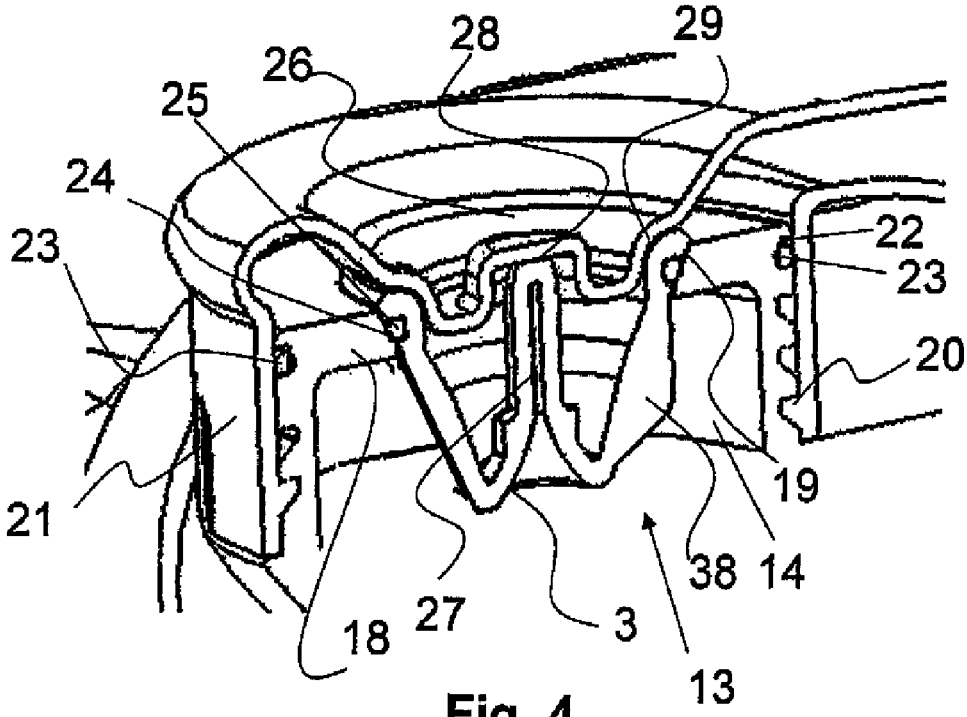
FIG. 4 shows a partial view of the spout with closed and locked pour-out valve, shown perspectively in section.

FIG. 4 shows a partial view of the pour-out tube 2 in the area of the spout 13 with closed and locked pour-out valve 3, shown perspectively in section. A collar 14 can be seen at the spout 13 of the container 1. The collar 14 is integrated in the upper wall of the container and has a circular constriction 18 at its upper opening. The inwardly directed surface 19 of this constriction 18 runs in a conically bevelled manner such that the diameter of the opening tapers in the direction of the container. This conical surface 19 forms the valve seat 19 for the pour-out valve 3. Instead of a conical surface 19, it is also feasible to have a concave surface 19 such as the inner surface of a spherical layer for example. As a result, inaccuracies in the axial position of the pour-out valve 3 can be reliably absorbed, ensuring secure sealing of the pour-out valve 3. The pour-out tube 2 has a pipe-like form. At its container-side end, the pour-out tube 2 opens in a cylindrical, upwardly closed and downwardly open cylindrical section 21. This cylindrical section 21 is placed on the collar 14 of the spout 13 and is operatively connected thereto via a thread 21. On pivoting the pour-out tube 2, the cylindrical section of the pour-out tube 2 is raised or lowered by the thread 20 according to the pivoting direction and specifically in such a manner that in the blocking position of the pour-out tube 2 the cylindrical section 21 is lowered the furthest and in the pour-out position, it is raised the furthest. A radially circumferential groove 22 is let into the upper edge zone of the collar 14, which serves to receive a first sealing element 23. This first sealing element 23 forms a sealed transition between the container 1 and the pour-out tube 2. The pour-out valve 3 is inserted in the circular constriction 18 of the spout 13. The valve cap of the pour-out valve 3 has a shape similar to a ring cake and in the upper outer edge zone, has a radially circumferential groove 24 for receiving a sealing element 25. In the closed state the sealing element 25 rests on the valve seat 19 and sealingly closes the opening of the spout 13. However, it is also feasible that the valve cap itself forms the sealing element 25, i.e. in that it is made entirely or in the area of the valve seat from a sealable material and thereby makes it possible to achieve a reliable and sealing closure of the spout 13 with the valve seat 19. Vertically running protuberances or ribs 38 are arranged on the outer wall of the valve cap, which centre the valve cap during closure of the valve 3 in the valve seat. The upper side of the cylindrical section 21 of the pour-out tube 2 has a plate-shaped recess 26. In the blocking position of the tube 2, the side wall 29 of the plate-shaped recess 29 presses against the upper edge of the pour-out valve 3 and thereby presses the valve seal 25 against the valve seat 19. The cooperation of the upper edge of the pour-out valve 3 with the plate-shaped recess 26 of the pour-out tube 2 forms a blocking device for the pour-out valve 3, which can thereby not be raised from the valve seat 1.9 in the blocking position.

Figure 5:
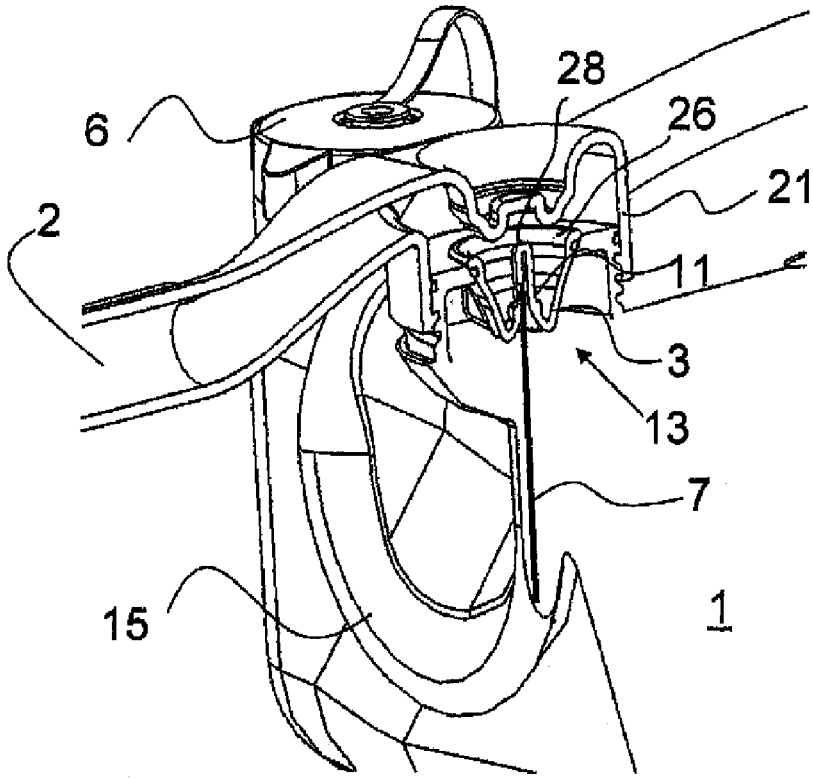
FIG. 5 shows a partial view of the spout with closed and unlocked pour-out valve, shown perspectively in section.

FIG. 5 shows a partial view of the container 1 in the area of the spout 13 with closed and unlocked pour-out valve, shown perspectively in section. The pour-out tube 2 is pivoted into the pour-out position, whereby the cylindrical section 21 is raised to its highest position. The plate-shaped recess 26, 28, 29 of the pour-out tube 2 no longer lies on the valve pin 27 and on the upper edge of the pour-out valve 3. As a result, the pour-out valve is displaceable in the axial direction. A helical compression spring 11 is arranged around the valve pin 27 between the centre of the plate-shaped recess 28 of the pour-out tube 2 and the pour-out valve 3, which spring presses the pour-out valve 3 from the underside of the plate-shaped recess 28 into the valve seat 19. The pour-out valve is thereby unlocked but is closed due to the compression spring 11. At the centre the valve pin 27 has hole running axially in the direction of the container which serves to receive the push rod 7.

Figure 6:
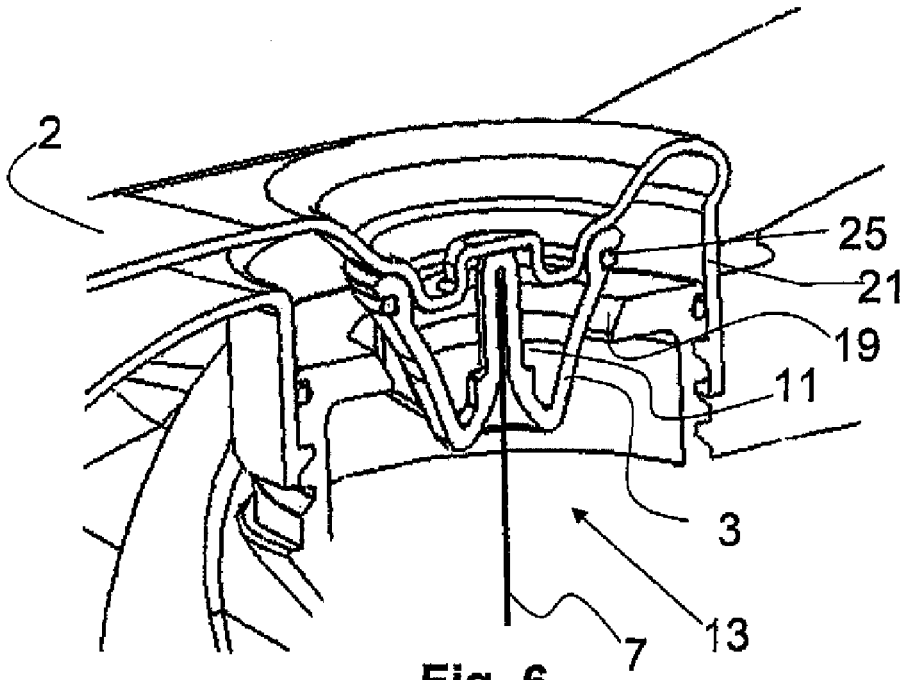
FIG. 6 shows a partial view of the spout with open and unlocked pour-out valve, shown perspectively in section.

FIG. 6 shows a partial view of the pour-out tube 2 in the area of the spout 13 with open and unlocked pour-out valve 3, shown perspectively in section. The push rod 7 pushes the pour-out valve 3 against the spring force 11 from the valve seat 19 so that the spout 13 is released and the free-flowing medium can flow out through the pour-out tube 2 when the container is suitably inclined.

Figure 7:
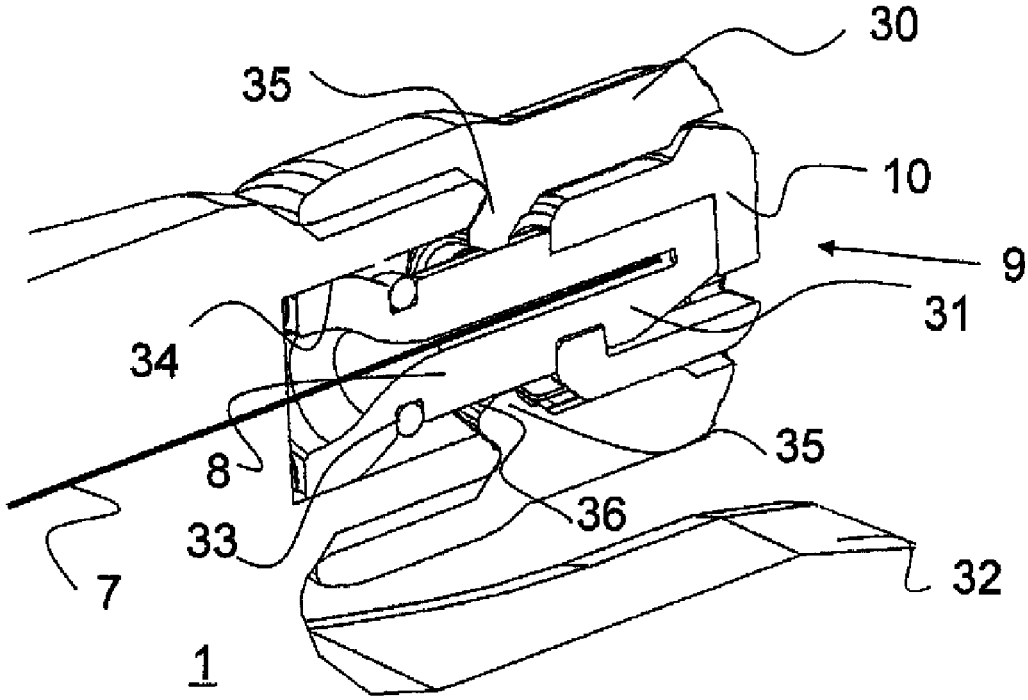
FIG. 7 shows the push button of the pour-out valve with open venting valve, shown perspectively in section.

FIG. 7 shows the actuating device 9 with the push button 10 for actuating the pour-out valve 3 with open venting valve 8, shown perspectively in section. On the outer upper side of the container, a cylindrical projection running approximately parallel to the upper side of the container having the opening 34 is integrated in the wall of the container 1. The actuating device 9 is placed or sealingly screwed onto this projection having the opening 34. The actuating device 9 consists of a valve holder 30, a venting piston 31 and a push button 10. The valve holder 30 has a constriction 35 with an inwardly directed sealing surface 36. At its container-side end the venting piston 31 has a diameter which approximately corresponds to that of the cylindrical opening 34. Towards the outside the diameter of the venting piston 31 tapers towards the diameter of the constriction 35 in the holder 30. The venting piston 31 is thereby guided in the inner wall of the opening 34 and in the constriction of the holder 30 and is displaceable in the axial direction. In the transition zone from larger to smaller diameter of the venting pistons 31, there is provided a radially running groove with a valve seal 33 for the venting valve 8. This venting valve 8 is obtained from the cooperation of the venting piston 31 with the seal 33 and the constriction of the holder 30 with its sealing surface 36, which forms the valve seat for the venting valve 8. A hole on the container-side end serves to receive the push rod 7.

Figure 8:
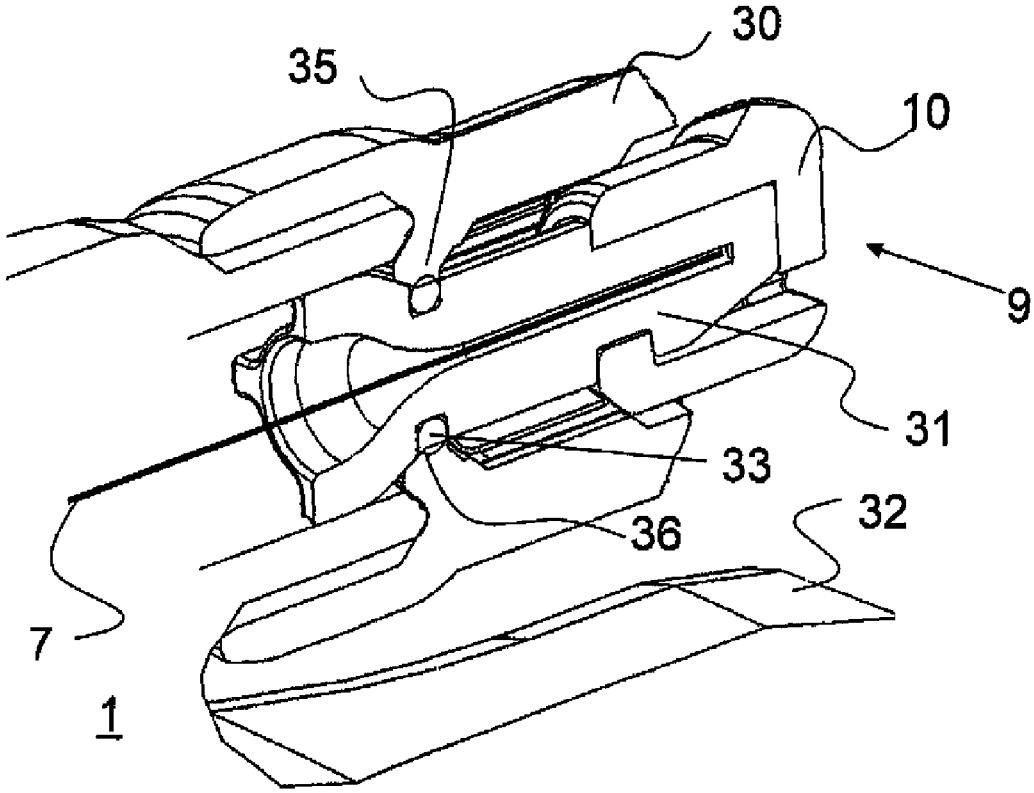
FIG. 8 shows a partial view of the push button for actuating the pour-out valve with closed venting valve.

FIG. 8 shows the actuating device 9 with the push button 10 for actuating the pour-out valve 3 with closed venting valve 8, shown in perspective view. The push rod 7 is pressed by the compression spring 11 in the pour-out valve 3 in the direction of the actuating device 9. As a result, the venting piston 31 with its seal 33 is pressed towards the back against the sealing surface 36 in the constriction 35 of the holder 30, the valve seat and the container 1 is sealed towards the outside. If, by pressing on the push button 10, the venting piston 31 and the push rod 7 are pushed against the spring force of the compression spring 11 in the direction of the container, the venting valve 8 and the pour-out valve 3 are raised from the valve seats and pressure equalization with the ambient air pressure can be effected in the container 1 by the venting valve. The content can be emptied from the container through the opened spout. In order to prevent unintentional opening of the venting valve, a blocking device is provided on the actuating device. An axially disposed groove runs in the outer region of the holder which is designed to receive a cam disposed on the push button 10. The push button 10 is rotatable about the longitudinal axis with the venting piston 31. As soon as the venting valve 8 is closed, the cam is located outside the groove and the push button 10 can be turned. An axial displacement of the push button 10 or the venting valve 8 is only possible however, when the push button is positioned or turned such that the cam engages in the groove. That is, when the venting valve is closed, the push button is turned into a blocking position, thereby locking the venting valve. Only when the push button 10 is turned back into that position in which the cam engages in the groove, can the push button be pressed and the valve is actuated. The push button 10 and the venting piston 31 are guided in a link in the holder 30 of the venting piston 31. On turning the push button 10 from the open position into the locking position, this is displaced with the venting piston 31 in the axial direction away from the container so that the seal 33 of the venting piston 31 against the valve seat 36 is pulled or pushed in the holder 30. An engaging mechanism is also provided on the push button 10 which engages in the holder and on the one hand allows a specific and pre-defined positioning of the push button 10 and on the other hand secures the push button 10 against unintentional twisting from the blocking position. The container is hermetically sealed by the locking of the pour-out valve 3 and the venting valve 8 so that some of the filling medium cannot escape through the pour-out valve 3 nor through the venting valve out from the container nor can liquid penetrate into the container from outside. Even when the pour-out and/or venting valve is unlocked, with the arrangement for pouring out free-flowing media according to the invention, the container 1 is tightly closed so that none of the contents can flow out of the container even when it is tipped over. The container can only be emptied when the valves are unlocked and opened by pressing the button.

Figure 9:
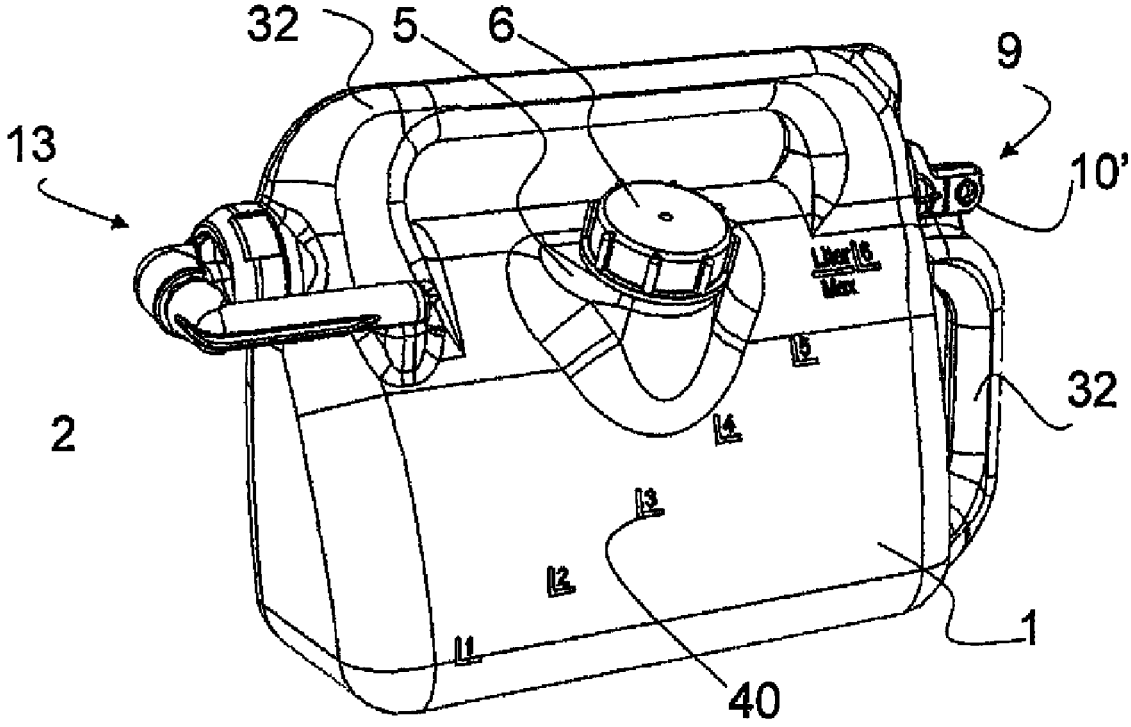
FIG. 9 shows a further embodiment of the container with integrated pour-out arrangement in perspective view with closed and locked spout and with closed and locked actuating device.

A further embodiment of a container 1 with integrated pouring out arrangement is shown in FIG. 9. The essential components of this arrangement are again a pour-out tube 2 disposed pivotally on the spout 13 of the container 1, a pour-out valve disposed inside the spout 13 and a lock for the pour-out valve, an actuating device 9 with a pressure slider 10' for actuating the pour-out valve, a connecting member between the push lever 10' and the pour-out valve, i.e. a push rod and a venting valve lockable with the pressure slider 10', which is integrated in the actuating device 9. A filling opening 5 which can be closed with a lid 6 is further provided in the upper region on the container side. The container 1 has an upwardly tapering shape so that the filling opening 5 does not protrude beyond the base surface of the container 1 in the projection. This has the advantage that the containers can be stored adjacent to one another, bottom surface on bottom surface. A handle 32 is integrated in the container on the upper side and on the rear side wall. The cavities of the handles 32 are connected to the interior of the container 1 so that when the container 1 is filled and closed, a sufficiently large gas cushion remains which can absorb the volume or pressure fluctuations accompanying temperature fluctuations. The actuating device 9 is arranged close to the handle 32 on the rear side wall so that the container 1 can be held by the handle 32 with one hand and the pressure slider 10' on the actuating device 9 can be operated with the same hand. The pour-out tube 2 is pivoted over the container 1 and is located in the blocking position. In this position, the pour-out valve is locked and the container 1 tightly closed. A marking 40 can be seen on the side wall of the container 1. If the container wall is transparent, this marking 40 can reveal the amount of liquid in the container both in the vertical and in the horizontal holding position of the container 1.

Figure 10:
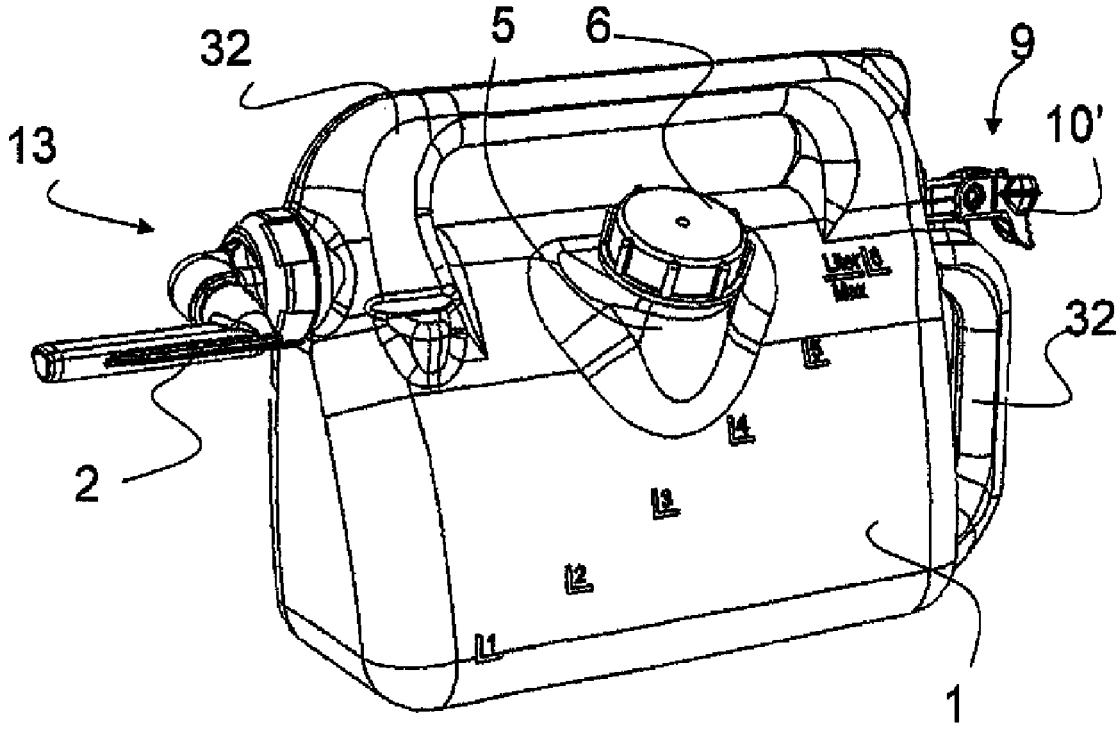
FIG. 10 shows the container design as in FIG. 9 with unlocked spout and unlocked actuating device.

FIG. 10 shows the container 1 with the pour-out tube 2 pivoted ready for pouring out, that is in this position the pour-out valve is unlocked but still closed. The pressure slider 10' is pivoted backwards, thereby unlocking the actuating device 9. The locking of the actuating device 9 will be described in detail in the following. By pressing the pressure slider 10', the push rod is pressed against the pour-out valve which is thereby opened, In the embodiment shown the pour-out tube 2 is pivotable by about 180° in a vertical plane from the blocking position into the pour-out position. In the unlocked position, the pour-out tube 2 points away from the container 1. A lug 41 can further be identified on the upper side the side wall of the container 1, said lug being formed by a protuberance in the container wall and serving to receive the pour-out tube 2 in the blocking position.

Figure 11:
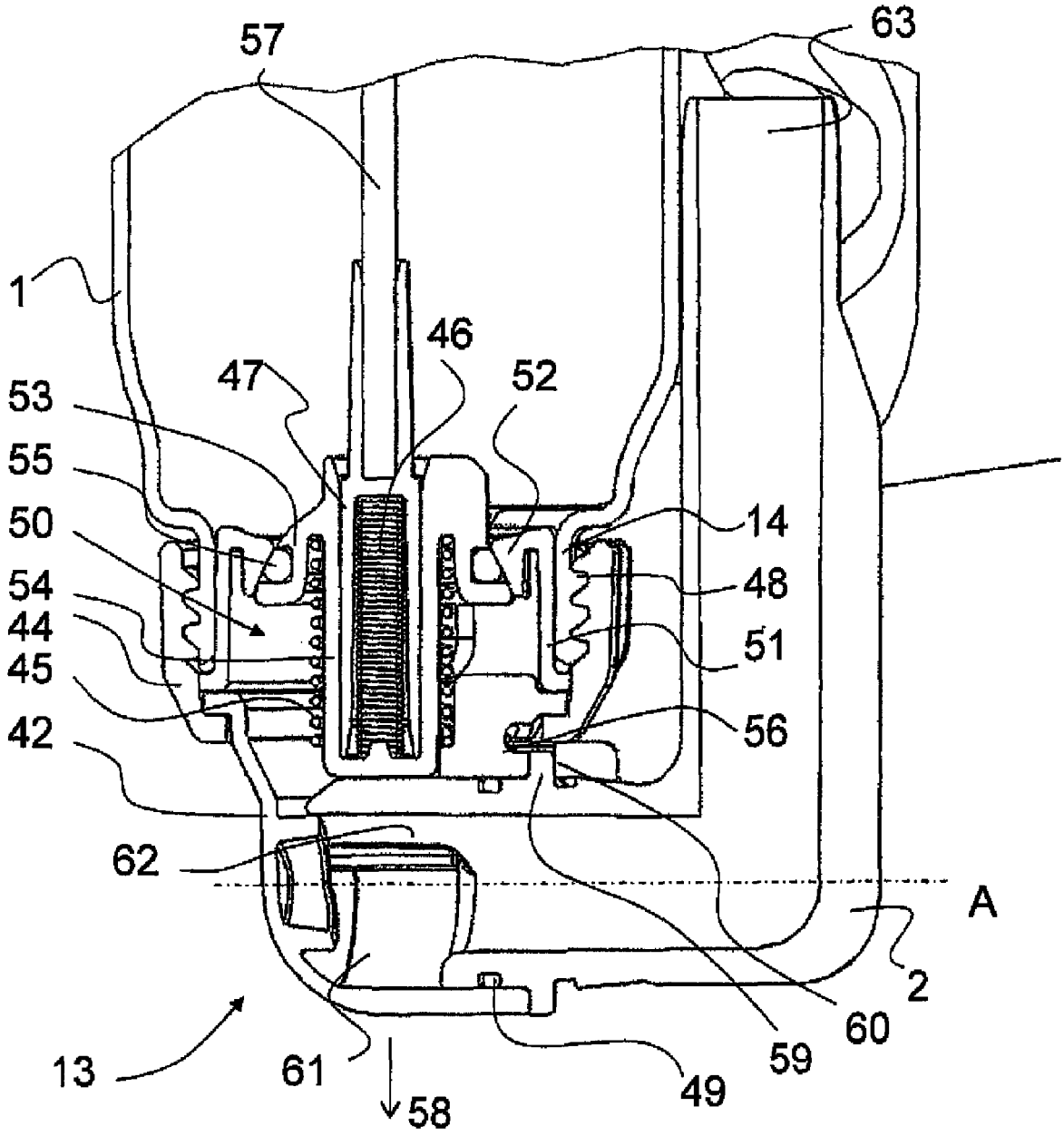
FIG. 11 shows a partial view of the spout with closed and locked pour-out valve, shown in a horizontal section.

FIG. 11 shows a partial view of the spout 13 with closed and locked pour-out valve 50, shown in a horizontal section. The container opening with the collar 14 and the spout 13 disposed thereon can be seen. The spout 13 consists of the valve 50 with the valve seat 52 and the valve disk 53 inserted in the collar 14, as well as the housing 42 and the pour-out tube 2. The spout 13 is screwed to the collar 14 of the container 1 by means of the retainer nut 44. A cylindrical element 51 is inserted in the collar 14, said element having a rim at one end which rests sealingly on the collar edge and having a conically running surface at its end facing the interior of the container 1, which forms the valve seat 52 for the valve disk 53. The valve disk 53 has a radially circumferential groove for receiving a sealing element 55. In the closed state, the sealing element 55 rests on the valve seat 52 and sealingly closes the opening of the spout 13. At the centre of the valve disk 53, this has a forwardly directed valve sleeve 54. The push rod sleeve 47 is mounted displaceably in the longitudinal direction in said valve sleeve 54. A compression spring 46 is inserted between the push rod sleeve 47 and the valve sleeve 54, which spring pushes the push rod sleeve 47 in the direction of the container interior away from the valve sleeve 54. At its rear end, said push rod sleeve 47 has a sleeve-shaped opening for receiving the pushrod 57. The edge of the housing 42 rests on the outer edge of the rim of the cylindrical element 51 which is held by the retainer nut 44. The retainer nut 44 is screwed to the container collar 14 by means of the thread 48. In the connecting region to the cylindrical element 51, the housing 42 has a plurality of radially inwardly running webs 56 which serve to receive a compression spring 45. This compression spring 45 extends over the valve sleeve 54 and rests with its second end on the valve disk 53, and presses this against the valve seat 52, whereby the container 1 is sealingly closed in the area of the spout 13.

In the housing 42 the pour-out tube (2) is rotatably mounted about an imaginary axis A which runs perpendicular to the outflow direction 58 from the container 1. The pour-out tube 2 has a 90° curvature in such a manner that when the spout 63 of the pour-out tube 2 pivots vertically, the pour-out tube 2 turns about the imaginary axis A. A seal 49 is provided on the housing 42 for sealing the pour-out tube 2. A web 59 disposed on the circumference of the pour-out tube 2 engages in a recess 60 in the housing 42 and guides the pour-out tube 2 during pivoting. In the end region of the pour-out tube 2 in the housing 42, the tube has an opening 61 in the tube jacket 62 which is disposed such that it is oppositely directed to the outflow opening 63 of the pour-out tube 2. That is to say, the opening 61 in the tube jacket 62 is facing the container collar 14 when the outflow opening of the pour-out tube 2 is pivoted away from the container. As soon as the outflow opening 63 of the pour-out tube 2 points towards the container 1, the opening 61 in the tube jacket 62 faces away from the container collar 14. In this case, the valve sleeve 54 abuts against the tube jacket 62 and this presses the valve sleeve 54 with the valve disk 53 against the valve seat 52. In this position, the pour-out valve 50 is locked and cannot be opened with the pushrod 57.

Figure 12:
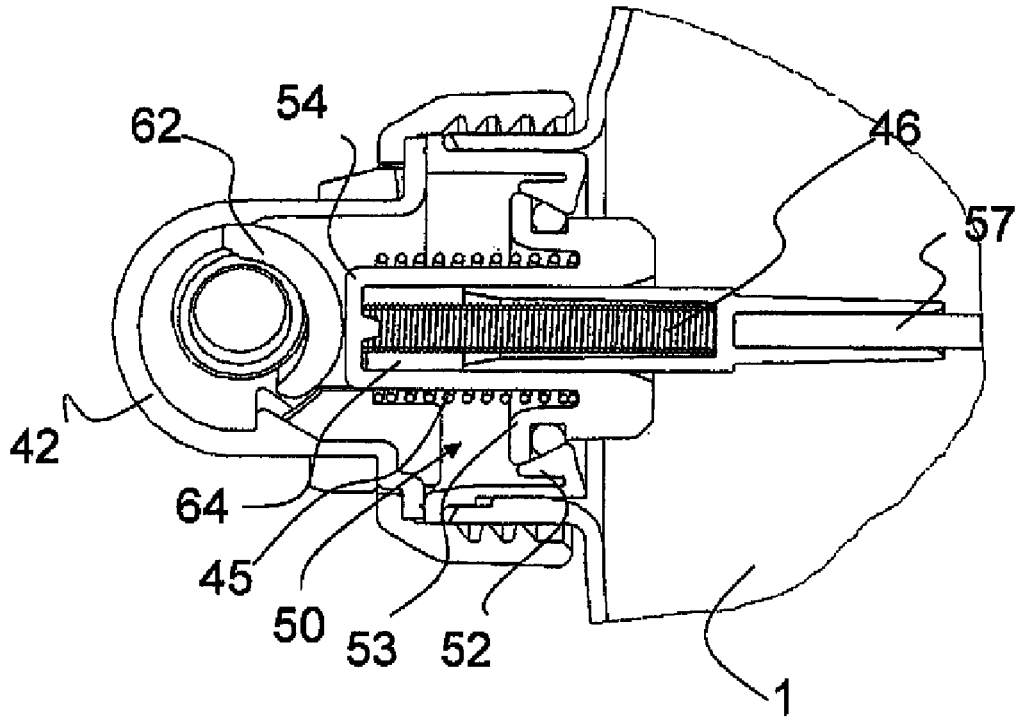
FIG. 12 shows a partial view of the spout with closed and locked pour-out valve, shown in vertical section.

FIG. 12 shows the same area of the container 1 as in FIG. 11 but in a vertical section. The tube jacket 62 appears half-moon-shaped. The valve sleeve 54 is blocked by the tube jacket 62 in such a manner that the valve 50 cannot be opened. To actuate the pour-out valve 50, the push rod sleeve 47 must be pushed with the push rod 57 against the spring force of the first compression spring 46 in the valve sleeve 54 in the direction of the pour-out tube 2. Depending on the ratio of the spring force of the first compression spring 45 to the second compression spring 46, in extreme cases the push rod 57 must possibly be pushed forward until the lower edge zone of the push rod sleeve 47 reaches the bottom of the valve sleeve 54 and only then during further pressing of the push rod 57 against the spring force of the compression spring 45, is the valve disk 53 raised from the valve seat 52 and the container opening is opened. In this case, the first compression spring 46 in the push rod housing 47 on the one hand has the task of pressing the push rod 57 towards the back and holding the valve of the actuating device 9 closed, and on the other hands it has the task of compensating for length fluctuations of the push rod 57. The container 1 and the push rod 57 expand differently according to filling, temperature and pressure so that the spacing between the valve disk sleeve 54 and the actuating device 9 varies. Therefore, in order to compensate for the different expansion of the container 1 and the push rod 57, a compensating path 64 is provided in the valve sleeve 54. This means that the push rod sleeve 47 projects to different depths in the valve sleeve 54 when the container is closed and locked, depending on temperature, pressure and filling of the container 1.

Figure 13:
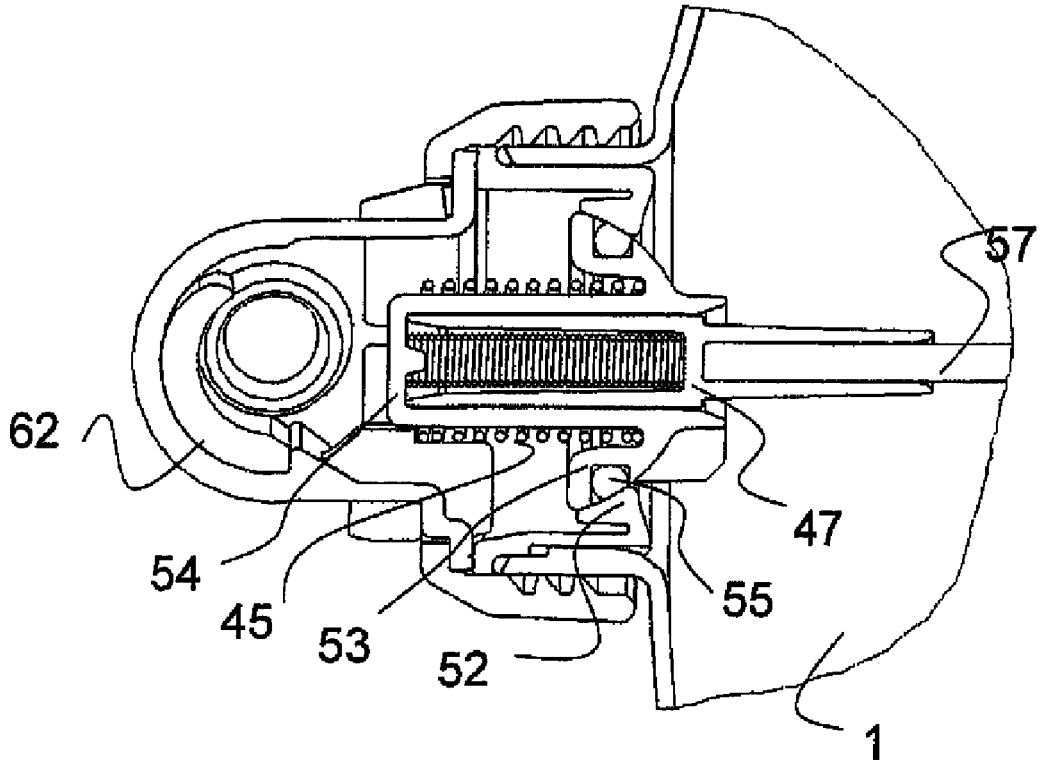
FIG. 13 shows a partial view of the spout with closed and unlocked pour-out valve, shown in a vertical section.

FIG. 13 shows a partial view of the spout 13 with closed and unlocked pour-out valve 50, in a vertical section. The spout is unlocked by pivoting the pour-out tube 2. The tube jacket 62 exposes the valve sleeve 54 so this can be pushed forwards. The push rod 57 is pushed forwards until the push rod sleeve 47 has reached the bottom of the valve sleeve 54.

The valve disk 53 with its valve seal 55 is pushed further against the valve seat 52 by the compression spring 45. The valve 50 is still closed.

Figure 14:
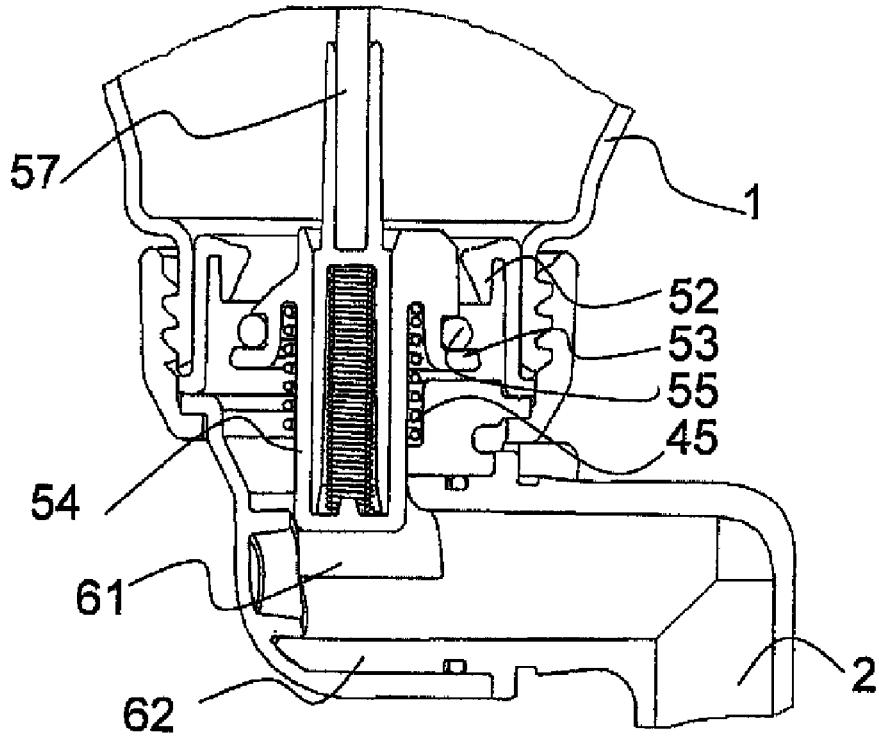
FIG. 14 shows a partial view of the spout with opened pour-out valve, shown in a horizontal section.

FIG. 14 shows a partial view of the spout 13 showing the opened pour-out valve 50 in a horizontal section. The pour-out tube 2 is pivoted forwards away from the container 1, thus unlocking the spout. By pressing against the spring force 45, the valve sleeve 54 is pushed forwards into the opening 61 in the tube jacket 62 of the pour-out tube 2 and the valve disk 53 with the seal 55 is raised from the valve seat 52. The spout of the container 1 is thereby opened and the medium located in the container can flow through the opened pour-out valve 50 into the pour-out tube 2.

Figure 15:
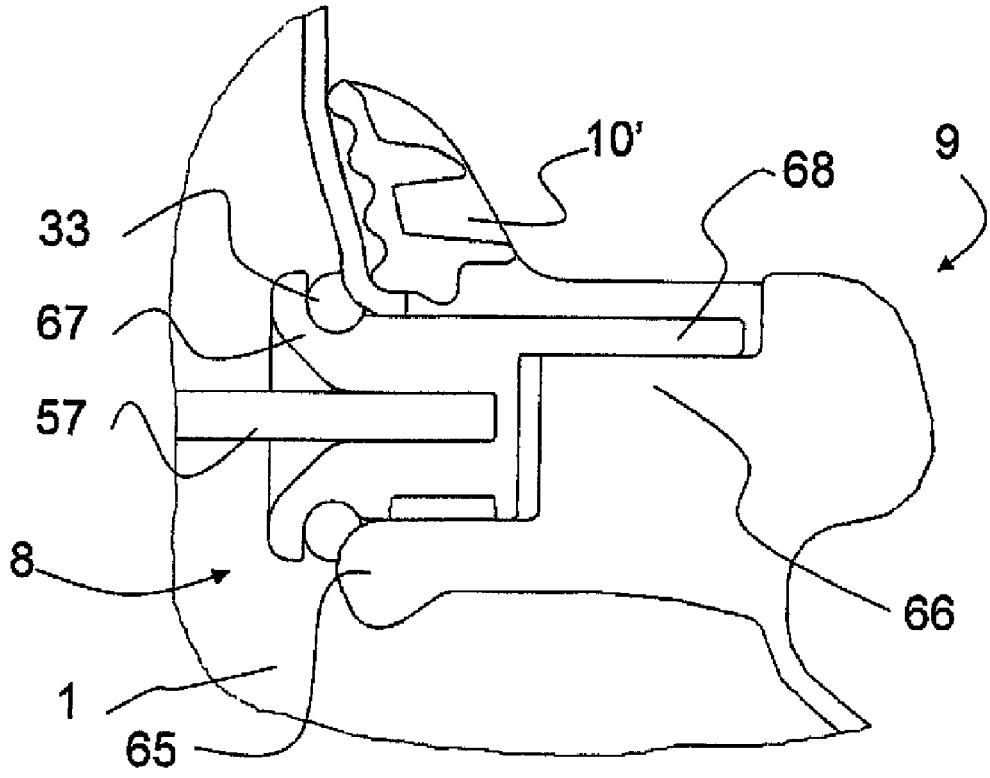
FIG. 15 shows a partial view of an actuating device for actuating the pour-out valve with closed and locked venting valve, shown in a vertical section.

FIG. 15 shows a partial view of the container 1 showing the actuating device 9 for actuating the pour-out valve 50 with closed and locked venting valve 8, shown in a vertical section. The actuating device 9 consists of the venting valve 8 and the pressure slider 10'. The upper handle end of the rear container handle 32 is configured as a guide rail 66. The container wall of the container 1 has an opening in the area of the guide rail 66, whose inner edge forms the valve seat 65. In the inner area the valve disk 67 has a blind hole for receiving the push rod 57. In the closed state the compression spring 46 presses the push rod 57 towards the back and the valve disk 67 with the seal 33 rests sealingly on the valve seat 65. The valve disk 67 is guided displaceably along the rail 66 with its backwardly projecting U-shaped neck 68. A vertically pivotable pressure slider 10' is located at the outer end of the valve neck 68. In FIG. 15 the slider 10' is pivoted forwards and presses against the wall of the container 1. The valve disk 67 is thereby pressed against the valve seat 65 and blocks the venting valve 8 in the closed state.

Figure 16:
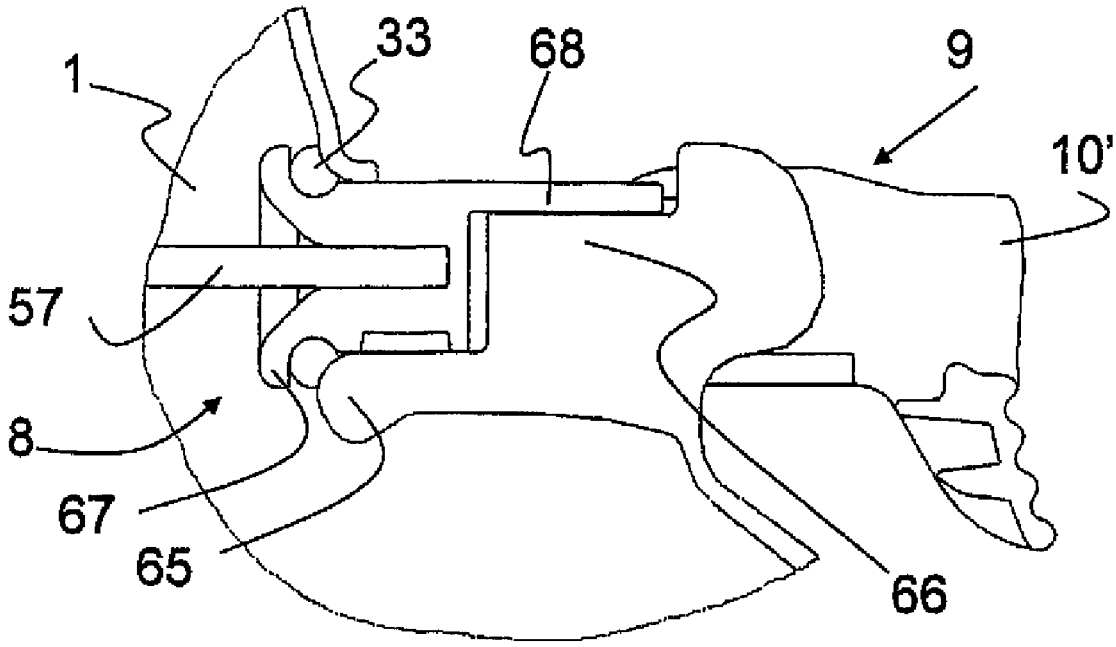
FIG. 16 shows a partial view of an actuating device with closed and locked venting valve, shown in a vertical section.

FIG. 16 shows the actuating device 9 with rearwardly hinged pressure slider 10' for actuating the pour-out valve 50 with the venting valve 8 closed. The push rod 57 is pressed by the compression spring 45 in the direction of the actuating device 9. The valve disk 67 with its seal 33 is thereby pressed towards the back towards the valve seat 65 and the container 1 is sealed towards the outside. The outwardly directed surface of the pressure slider 10' is configured so that it is easy to reach and operate with the thumb when the container 1 is held with one hand on the rear handle 32.

Figure 17:
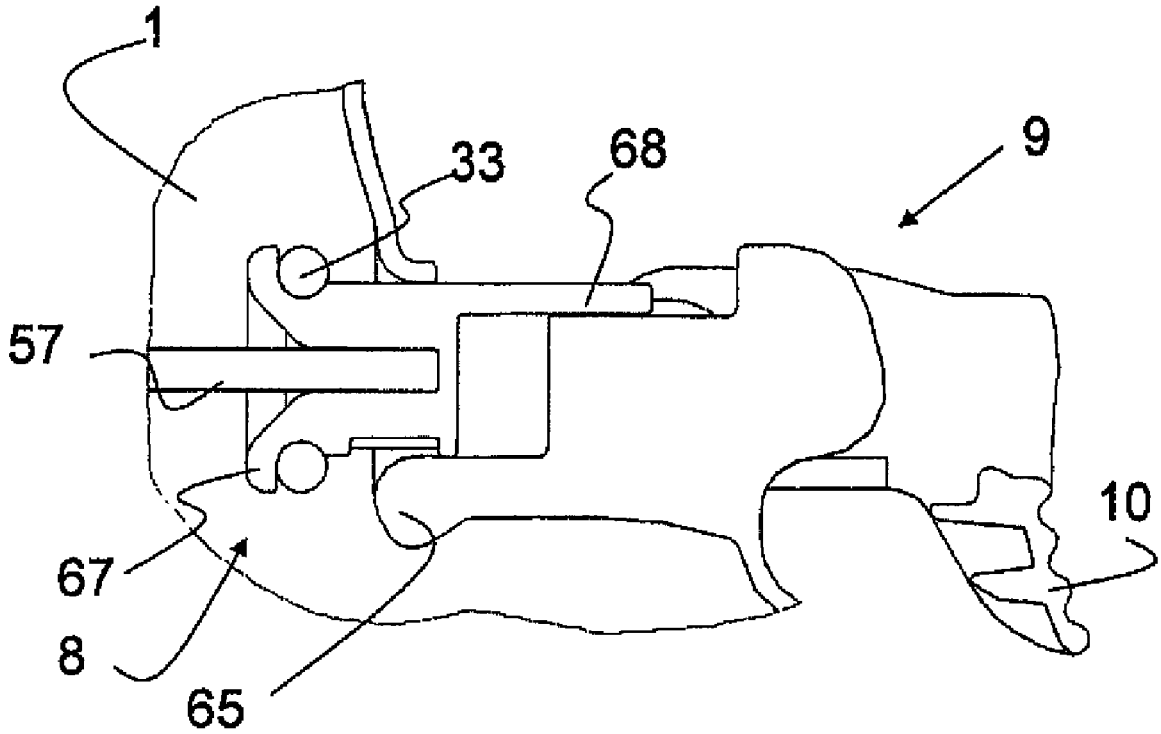
FIG. 17 shows a partial view of an actuating device with opened venting valve, shown in a vertical section.

FIG. 17 shows a partial view of the actuating device 9 with opened venting valve 8, shown in a vertical section. By pressing on the pressure slider 10' the valve disk 67 with the push rod 57 is pressed against the spring force of the compression spring 46 in the direction of the pour-out tube 2 and the venting valve 8 and the pour-out valve 50 are opened. Due to the opened venting valve 8 pressure equalization with the ambient air pressure can take place in the container 1 and the contents can be emptied from the container through the opened spout 13. In order to prevent unintentional opening of the venting valve 8, the pressure slider 10' is folded forwards, thus closing the pour-out valve 50 and closing and locking the venting valve 8.

The arrangement according to the invention for pouring out free-flowing media has been explained for two examples of a portable container in which the arrangement is integrated in the container or its walls. In a further embodiment the components of the arrangement are integrated in a container lid which can be screwed onto or placed onto a container by means of a sealing connection such as, for example a screw-lid connection or a bayonet plug-on connection. This has the advantage that a lid with the arrangement according to the invention can be used for containers of different sizes. In a further embodiment it is also feasible to integrate the arrangement for pouring out free-flowing media in a container intended to receive cartridges or cartouches.

What is claimed is:

1. An arrangement for pouring free-flowing media out of a container, said arrangement comprising:

a pour-out tube pivotally arranged about a pour-out opening of the container;

a pour-out valve having a pour-out collar for sealingly closing the pour-out opening of the container with the pour-out collar;

an actuator for actuating the pour-out valve; and a blocking device for locking the pour-out valve in a sealing position, wherein pivoting the pour-out tube causes the blocking device to lock or unlock the pour-out valve.

2. The arrangement of claim 1, wherein the actuator including a connecting member which is displaceable against a spring force of a spring element by a push button or pressure slider.

3. The arrangement of claim 1, wherein the collar is integrated in an upper container wall of the container and has a circular constriction at an upper opening of the collar to form an inwardly directed sealing surface which defines a valve seat, with said upper opening having a diameter which tapers in a direction of the container, further comprising a valve cap received in the circular constriction and having a sealing element which rests on the valve seat in a closed state, and a spring element provided between an inner side of the pour-out tube and the valve cap to press the valve cap into the valve seat.

4. The arrangement of claim 2, wherein the pour-out tube is arranged pivotally about an axis in parallel relationship to the pour-out collar, said connecting member of the actuator being guided in a channel formed in a wall of the container and displaceable along the channel.

5. The arrangement of claim 1, wherein the pour-out tube has a container-side end which terminates in a cylindrical section having a closed top and an open bottom, said cylindrical section being placed on the collar and operatively connected thereto via a thread so as to allow a movement of the cylindrical section between upper and lower positions in dependence on a pivoting direction of the pour-out tube, wherein in the lower position of the cylindrical section, a recess of the pour-out tube presses on the pour-out valve in such a manner that the sealing element of the valve cap is sealingly held in the valve seat and prevented from disengagement from the valve seat.

6. The arrangement of claim 1, further comprising a cylindrical element received in the collar and having one end formed with a rim which rests sealingly on a collar edge of the collar and has a conical surface at another end facing an interior of the container to form a valve seat for a valve disk of the pour-out valve, wherein the valve disk has a forwardly directed valve sleeve in midsection for movably supporting a push rod sleeve which has a rear end formed with a sleeve-shaped opening for receiving a push rod, and further comprising a first compression spring disposed between the push rod sleeve and the valve sleeve, a housing resting on an edge of the cylindrical element and screwed to the pour-out collar with a retainer nut, and a plurality of radially inwardly running webs arranged on the housing in a connecting region to the cylindrical element and receiving a compression spring which extends over the valve sleeve and has one end resting on the valve disk.

7. The arrangement of claim 6, wherein the pour-out tube is mounted in the housing for rotation about an imaginary axis which runs perpendicular to an outflow direction from the container, said pour-out tube having a 90° curvature so that the pour-out tube rotates about the imaginary axis in the housing when an outflow opening of the pour-out tube pivots vertically, said pour-out tube having a tube jacket formed in an area inside the housing with an opening disposed oppositely directed to the outflow opening of the pour-out tube, said valve sleeve abutting against the tube jacket and locking the pour-out valve when the outflow opening of the pour-out tube points towards the container.

8. The arrangement of claim 1, further comprising a venting valve cooperating with the actuator, wherein the venting valve opens under pressure and closes when the pressure is removed, said venting valve being locked in the closed state when the pour-out valve is locked.

9. The arrangement of claim 8, wherein the venting valve has a valve seat defined by an inner edge of an opening provided in a rear container wall of the container, with the container wall having an outwardly pointing guide rail in an area of the opening to receive a U-shaped neck of a valve disk of the venting valve, wherein the valve disk is displaceably guided along the rail and has a blind hole for receiving a push rod in an inner area, and further comprising a vertically pivotal pressure slider disposed at an outer end of the valve neck and locking the venting valve in the closed state, when the pressure slider is forwardly tilted towards the container wall.

10. The arrangement of claim 1, wherein the components of the pour-out arrangement are integrated in a lid which can be screwed or placed on a container.

* * * * *